United States Patent [19]

Bon

[11] Patent Number: 4,482,436

[45] Date of Patent: Nov. 13, 1984

[54] USE OF $H_2SO_4$ $H_3PO_4$ TO REMOVE ELECTROLYTIC DEPOSITS FROM SILVER CATHODE SURFACES

[75] Inventor: Charles K. Bon, Concord, Calif.

[73] Assignee: The Dow Chemical Company, Midland, Mich.

[21] Appl. No.: 521,859

[22] Filed: Aug. 10, 1983

[51] Int. Cl.[3] ..... C25B 3/04; C25B 1/20

[52] U.S. Cl. ..... 204/73 R; 204/56 R; 204/109; 204/130; 134/3; 134/41

[58] Field of Search ..... 204/129.75, 129.9, 73 R, 204/130, 56 R, 109; 134/3, 41; 252/79.2

[56] References Cited

U.S. PATENT DOCUMENTS 4,242,183 12/1980 Kyriacov ..... 204/73 R

OTHER PUBLICATIONS

Handbook of Chem. & Physics, 32nd Ed., Chem. Rubber Co., pp. 562–563.

Metals: by U. R. Evans et al., E. Arnold Ltd., p. 348.

Corrosion Handbook by H. H. Ulig, John Wiley & Sons, pp. 316–318.

*Primary Examiner*—Andrews: R. L.

*Attorney, Agent, or Firm*—Robert R. Stringham

[57] ABSTRACT

Less co-dissolution of silver results when base metal-containing deposits on the surfaces of silver objects are dissolved off with sulphuric or phosphoric acid, rather than hydrochloric acid.

10 Claims, No Drawings

USE OF $H_2SO_4$ $H_3PO_4$ TO REMOVE ELECTROLYTIC DEPOSITS FROM SILVER CATHODE SURFACES

BACKGROUND OF THE INVENTION

U.S. Pat. No. 4,242,183 discloses a type of silver cathode uniquely useful for the electrolytic reduction of tri- and tetrachloropicolinic acids in basic aqueous solution to the 3,6-dichloroacid. (The latter process is disclosed in detail in U.S. Pat. No. 4,217,185.) According to the '183 patent, the cathode is prepared for use by cleaning it with 1:1 water and concentrated HCl, anodizing it in aqueous base to form a surface layer of silver oxides and then electrolytically reducing the oxide layer in a specific manner to convert it to a "spongy" layer of silver microcrystals wet with aqueous base.

The activity of the cathode is impaired by formation thereon of deposits derived from cations of base metals (such as iron, nickel, copper, etc.) which may be present in the reagents used and/or may be products of corrosion of the anode or cell walls. Such deposits can be at least largely removed and the cathode activity correspondingly restored by rewashing the cathode with aqueous HCl, re-anodizing, etc. However, this procedure results in co-dissolution of silver in amounts which, after repeated reactivations of the cathode, represent a not-insubstantial expense.

Thus, a more selective agent than hydrochloric acid for removing base metal-derived deposits from silver cathode surfaces is highly desirable. Of the various reagents which might be considered, other mineral acids which are capable of dissolving base metals and/or their oxides at practicable rates are the most logical candidates as economic reagents.

It can be expected that silver in contact with the periphery of a surface deposit of (or derived from) a base metal will exhibit a different corrosion behavior with respect to a given acid than will silver in contact only with silver. Nevertheless, that which is known about the resistance of silver per se to corrosion by aq. HCl and other base metal-attacking acids could be expected to be helpful in choosing a possibly more selective acid. However, the meager information found in the literature suggests that hydrochloric acid is less corrosive to silver than the other common mineral acids.

U. R. Evans implies (*The Corrosion and Oxidation of Metals: Scientific Principles and Practical Applications;* Ed. Arnold Ltd., London, page 348 (1960)) that silver is generally more resistant to hydrochloric acid than to sulphuric acid by stating that "The use of silver to resist hydrochloric acid and of lead to resist sulphuric acid are connected with the low solubilities of silver chloride and lead sulphate." Similarly, according to *The Corrosion Handbook* (Uhlig, ed.), John Wiley & Sons, Inc., N.Y., pages 316–319 (1948) silver immersed for 24 hours in 30% HCl and 20% $H_2SO_4$ at their boiling points, under air, loses weight to the extent of 0.35 and 4.0 MDD (milligrams per square decimeter per day), respectively, and immersion in 50% $H_3PO_4$ at its boiling point, under air, results in a weight gain in the amount of 21.0 MDD (in the form of an adherent coating). Data is also given for 24 hour immersion in concentrated HCl (1.00 MDD), 10% $H_2SO_4$ (2.4 MDD) and 60% $H_2SO_4$ (26.0 MDD) at their boiling points. (HF and $HNO_3$ are well known to be highly corrosive to all but the noblest metals; no data for corrosion of silver by HBr was found.)

Since corrosion mechanisms are complex and dependent on a number of variables, teachings of the foregoing type do not foreclose the possibility that sulfuric or phosphoric acid might prove to be more selective than hydrochloric acid in application to base metal deposits on silver cathodes. However, they are certainly not encouraging in that regard.

SUMMARY OF THE INVENTION

It has now been discovered that less silver co-dissolution results when sulfuric or phosphoric acids are used to remove base metal-derived deposits or occlusions from silver surfaces than when hydrochloric acid is used.

The invention may be more narrowly defined as an improvement in a known process for reactivating a silver cathode. In the known process, aqueous HCl is used to dissolve off deactivating, base metal-containing deposits which have formed on the cathode. The improvement comprises substituting aqueous $H_2SO_4$ or $H_3PO_4$ for the hydrochloric acid, thereby co-dissolving substantially less of the cathode metal itself.

A particularly preferred embodiment of the invention may be defined as follows:

In the method of preparing a chlorine-substituted pyridine carboxylic acid wherein: a polychloropyridine carboxylic acid in basic aqueous solution is reduced at a silver cathode in an electrolytic cell also comprising a base metal anode, said cathode becomes at least substantially deactivated by formation thereon of deposits containing one or more metals derived from said anode in the course of said reduction and said cathode is reactivated by a procedure comprising dissolving off said deposits therefrom with aqueous HCl; the improvement comprising substituting aqueous $H_2SO_4$ for said aqueous HCl, thereby co-dissolving substantially less of the cathode metal itself.

In the most preferred embodiment of the invention, said anode consists of stainless steel and the polychloroacid is a tri- or tetrachloropicolinic acid.

DETAILED DESCRIPTION

In its broadest aspect, the present invention is not limited to the removal of base metal deposits from silver cathode surfaces but includes the use of aqueous $H_2SO_4$ or $H_3PO_4$ to remove base metal-containing deposits or occlusions from the surfaces of silver objects in general. However, it is particularly useful in the reactivation of silver cathodes which are of the unique type disclosed in the '183 patent cited earlier herein and are employed, in conjunction with base metal-containing anodes, for the reduction of C-Cl groups in polychloropicolinic acids.

Stainless steel has been found to be a good anode material for use in the electrolytic reductions of tetrachloropicolinate anions to 3,6-dichloropicolinate anions at a silver cathode. However, it has the drawback of being susceptible to attack by aqueous caustic (particularly at low base concentrations) and also by hydrochloric acid. Thus, stainless steel anodes not only tend to be a source of cathode-deactivating base metals but also are corroded if the cathode is cleaned simply by filling the cell with hydrochloric acid. In contrast, neither sulphuric or phosphoric acid attacks stainless steel. Thus, the present invention is particularly advantageous when the combination of a silver cathode and a stainless steel anode is used.

The silver object to be treated by the present process can be contacted with the acid in any suitable manner but preferably is immersed in a body of the liquid acid, which may be quiescent or moving. When the object is a cell component and the other components thereof are essentially inert to the acid, the immersion may be accomplished simply by filling the cell with acid. Alternatively, the acid may be flowed over the exposed surfaces of the silver component, as by gravity flow, and recirculated if desired.

The minimum time of contact between the silver and acid which is required to effect a satisfactory degree of cleaning will of course vary with such factors as the acid strength, the temperature, the amount of contaminants to be removed, the degree of agitation of the acid and the susceptibility of any other materials present to corrosion by the acid. This minimum time can readily be determined by those skilled in the art without undue experimentation. As a guide, however, it has been found that 10 minutes exposure of a silver screen cathode (contaminated with deposits containing base metals derived from a stainless steel anode) to 20% $H_2SO_4$ at room temperature is quite adequate. The only upper limit on contact time is that imposed by the fact that silver is corroded even by $H_2SO_4$ and $H_3PO_4$, albeit at relatively slow rates. Ordinarily, the minimum contact time required will also be the optimum time.

Either phosphoric or sulfuric acid (or mixtures thereof) may be used but sulfuric acid is preferred. Whichever acid is used advantageously contains at least some water and concentrations within the range of from about 10 to about 30% are preferred. Aqueous $H_2SO_4$ containing from about 15 to 25% of the acid is the acid of choice—particularly for cleaning of silver cathodes which have been used in basic media in combination with anodes consisting of iron and/or nickel and/or chromium.

Although the process of the invention may be carried out at reduced or elevated temperatures (with suitable adjustments in contact time), operation at ordinary ambient temperatures is simpler and is preferred.

If the silver object to be contacted with the acid has had long exposure to moist or contaminated air, the surfaces to be cleaned may be lightly abraded for a brief period to assist in breaking down any film which might tend to reduce the rate of dissolution of the base metal-derived deposits or inclusions to be removed. Otherwise, no pre-treatment, other than, perhaps, ordinary washing with water and a detergent will ordinarily be required.

Rinsing of the acid-cleaned object with water will normally be advisable—particularly when the presence of $H_2SO_4$ or $H_3PO_4$ would be detrimental to the contemplated use (as a cathode in a basic medium, for example).

EXAMPLES

The following examples are for purposes of illustration and are not to be construed as necessarily exhaustive of the scope of the present invention.

EXAMPLE 1

A silver screen that had been used as a cathode for the electrolytic reduction of sodium tetrachloropicolinate to the 3,6-dichloropicolinate in conjunction with a stainless steel anode was contaminated with surface deposits containing iron, nickel and chromium. Treatment of a piece of the screen with 20% $H_2SO_4$ at room temperature for ten minutes dissolved 1 mg/in$^2$ of iron, 0.375 mg/in$^2$ of chromium and 0.07 mg/in$^2$ of nickel from the surface of the piece; the amount of silver co-dissolved was only 0.07 mg/in$^2$. This compares to co-dissolution of 0.84 mg/in$^2$ of silver when approximately the same amounts of iron, nickel and chromium were removed from another piece of the screen by the same treatment, except that the acid used was 18% aq. HCl.

Thus, the rate of silver corrosion by $H_2SO_4$ was 1/12 the rate for 18% HCl.

EXAMPLE 2

When tested in essentially the manner of Example 1, aq. $H_3PO_4$ (20%) was found to be less effective than HCl for base metal removal but also sufficiently less corrosive to silver to be preferable to aq. HCl.

What is claimed is:

1. An improvement in the method of removing base metal-containing deposits or occlusions from the surfaces of silver objects wherein the object is contacted with hydrochloric acid, said improvement comprising using sulfuric or phosphoric acid instead of the hydrochloric acid, thereby co-dissolving substantially less silver.

2. The method of claim 1 wherein said object is a silver cathode which has become substantially deactivated by formation on the surface thereof of said deposits.

3. The method of claim 2 in which said cathode has been employed in conjunction with a ferrous metal anode and said deposits are derived from said anode.

4. The method of claim 3 in which said anode is stainless steel.

5. The method of claim 1 wherein said acid is aqueous $H_2SO_4$ or $H_3PO_4$ having an acid concentration of from about 10 wt. % to about 30 wt. %.

6. The method of claim 5 wherein the acid employed is aqueous $H_2SO_4$ having a concentration of from about 15 to about 25 wt. %.

7. The method of claim 2 wherein said cathode and anode have been employed for the electrolytic reduction of a polychloropyridine carboxylic acid in a basic, aqueous medium.

8. The method of claim 7 wherein said anode is stainless steel.

9. The method of claim 8 wherein said polychloroacid is a tri- or tetrachloropicolinic acid.

10. The method of claim 9 additionally comprising rinsing the acid-treated cathode with water, anodizing it in aqueous base to form a surface layer thereon of silver oxides, converting said layer to a spongy layer of silver microcrystals by electrolytically reducing said oxides in said basic aqueous medium and re-using the cathode for reduction of more of said tri-or tetrachloropicolinic acid.

* * * * *